US006544019B2

(12) United States Patent
Martin et al.

(10) Patent No.: US 6,544,019 B2
(45) Date of Patent: Apr. 8, 2003

(54) PUMP WITH MAGNETIC CLUTCH

(75) Inventors: Hans Martin, Stuttgart (DE); Jürgen Bohner, Bad Waldsee (DE); Raimund Rosch, Munich (DE)

(73) Assignee: Schwäbische Hüttenwerke GmbH, Aalen-Wasserlfingen (DE)

( * ) Notice: Subject to any disclaimer, the term of this patent is extended or adjusted under 35 U.S.C. 154(b) by 0 days.

(21) Appl. No.: 09/905,771

(22) Filed: Jul. 13, 2001

(65) Prior Publication Data

US 2002/0068000 A1 Jun. 6, 2002

(30) Foreign Application Priority Data

Jul. 13, 2000 (DE) ..... 100 33 950

(51) Int. Cl.[7] ..... F04C 2/10; F04C 15/04
(52) U.S. Cl. ..... 418/69; 418/171
(58) Field of Search ..... 418/69, 166, 171, 418/21

(56) References Cited

U.S. PATENT DOCUMENTS

| | | | | |
|---|---|---|---|---|
| 4,004,412 A | * | 1/1977 | Burnell | 417/15 |
| 4,747,744 A | | 5/1988 | Dominique et al. | 418/171 |
| 6,007,303 A | | 12/1999 | Schmidt | 417/223 |

FOREIGN PATENT DOCUMENTS

| | | | | |
|---|---|---|---|---|
| DE | 85 19 180 | | 12/1985 | |
| DE | 197 36 797 | | 2/1999 | |
| EP | 0 855 515 | | 7/1998 | |
| JP | 63-113191 | * | 5/1988 | 418/166 |
| JP | 2-153281 | | 6/1990 | |
| WO | WO 98/42985 | | 10/1998 | |
| WO | WO 00/29741 | | 5/2000 | |

OTHER PUBLICATIONS

Abstract of Japanese Patent Publication No. 63–113192, published May 18, 1988.
European Search Report dated Nov. 1, 2002, from corresponding European Patent Application No. 01 11 6648.

* cited by examiner

*Primary Examiner*—John J. Vrablik
(74) *Attorney, Agent, or Firm*—RatnerPrestia

(57) ABSTRACT

The invention is related to a pump, preferably a positive-displacement pump, comprising:

a) a rotary drive member (1) driven at a speed dependent on a speed of a driving motor;

b) a casing (3);

c) and a first feed wheel (5) arranged in said casing (3), said first feed wheel (5) being coupled to said rotary drive member (1) for introducing a torque;

d) said first feed wheel (5) forming, with the walls of said casing alone or in conjunction with a second feed wheel (6), a delivery space (7) comprising a low-pressure side (8) connected to a pump inlet port and a high-pressure side (9) connected to a pump outlet port;

wherein:

e) limiting delivery of said pump is achieved by using a magnetic clutch (11–17) which couples said rotary drive member (1) to said first feed wheel (5) for transmitting said torque;

f) an input half (11–14) of said magnetic clutch (11–17) is non-rotatably connected to said rotary drive member (1), and an output half (15–17) of said magnetic clutch (11–17) is non-rotatably connected to said first feed wheel (5);

g) and said magnetic clutch (11–17) is designed with regard to a limiting torque, such that when said output half (15–17) reaches a speed predefined by the design, it no longer increases, or at least increases more slowly than the speed of said input half (11–14) when said input half (11–14) exceeds said predefined speed, wherein said predefined speed is less than a maximum operating speed of said input half (11–14).

35 Claims, 5 Drawing Sheets

PUMP WITH MAGNETIC CLUTCH

BACKGROUND OF THE INVENTION

1. Technical Field

The invention relates to pumps, in particular to positive-displacement pumps, for oil and other media, preferably liquids. In particular, the invention relates to pumps comprising means of limiting and/or varying delivery. One preferred field of application is in motorized land, air and water vehicles, in particular automobiles and heavy goods vehicles. However, pumps in accordance with the invention are also advantageously applicable in other fields, for example the hydraulic supply of a press.

2. Description of Related Art

In EP 0 994 257 A1 an external gear wheel pump is described, which varies the specific displacement, i.e. displacement/pump speed. This variation is achieved by altering the meshing length of two meshed gear wheels. For this purpose, one of the gear wheels is supported on a piston, receiving on one side the pressure of the pump and on the other side the pressure of a spring, opposing the pump pressure.

A fluid machine in the form of a vane pump including a magnetic clutch is known from EP 0 855 515 A1, for application as a governed motor vehicle coolant pump. The magnetic clutch is adjusted according to the rotational speed, as measured by a sensor, to deliver the coolant according to requirement. Adjustment is achieved by a servomotor and a mechanical gear wheel unit.

In gear wheel pumps, however, for example external and internal gear wheel pumps forming preferred examples of oil pumps in accordance with the invention, two gear wheels mesh and, together with the walls of a surrounding casing, form a displacement space through which the medium to be displaced is delivered, from a low pressure side to a high-pressure side of the pump. The low-pressure side is connected to an inlet port and the high-pressure side to an outlet port of the pump.

In known gear wheel pumps, one of the two gear wheels of a gear wheel set is supported by the casing of the pump. The other gear wheel is rotationally driven by a rotary drive member and is non-rotatably connected to the rotary drive member for this purpose. The rotary drive member supports this gear wheel. In general, the gear wheel is directly connected non-rotatably to the rotary drive member. The rotary drive member is in turn rotatably supported relative to the casing. For reasons of production tolerances, inaccuracies in assembly and loads occurring during operation, the rotary drive member "works" relative to the casing. Accordingly, undesirable movements of the gear wheels of the gear wheel pump relative to each other, for example tilting, also arise.

Positive-displacement pumps, in particular gear wheel pumps, generally comprise a specific delivery [displacement/feed-wheel speed] which is constant according to the system involved, because the geometry of the displacement pockets cannot be altered. They show a proportionality of delivery to speed, as long as the filling ratio of the displacement pockets is 100%. However, in many applications this proportionality is disruptive and undesirable. In a press for example, although a high delivery of the hydraulic fluid is necessary for the rapid motion, only high pressure is required in the end phase of the working stroke, and the oil delivery requirement drops to zero. Since the drive speed of such pumps in presses remains as a rule constant, a high-pressure excess flow of oil arises, which is returned to the fluid reservoir afflicted with a loss of energy. Such an excess flow is particularly disruptive, for example, in automotive engine lube pumps and in automatic transmission fluid pumps. At low engine speeds and thus low pump speeds, these assemblies do require a minimum delivery when idling, and a minimum fluid pressure at high speed, however the flow requirement at high speed is well under the proportionality line, at top speeds mostly under a third of the proportionality flow.

SUMMARY OF THE INVENTION

It is an object of the invention to reduce noise and wear in pumps, preferably in oil pumps and hydrostatic pumps in general, said pumps having means for limiting or varying delivery, or both in combination.

This object is achieved by the subject matters of the independent claims. The sub-claims describe particularly preferred embodiments of pumps.

In accordance with the invention, a pump, preferably a gear wheel pump, is driven via a magnetic clutch. By a rotational drive of the pump being transmitted from a rotary drive member via a magnetic clutch to one of the at least two feed wheels of the pump, the feed wheel nearest to the rotary drive member in the flow of the force, termed the first feed wheel in the following, can be supported independently of the rotary drive member. No mechanical, in particular no positively locking, drive coupling exists between the rotary drive member and the first feed wheel. Possibly occurring, unavoidable friction forces can be assumed to be negligible. In this sense, the first feed wheel is freely rotatable relative to the rotary drive member, aside from the drive coupling produced by the magnetic clutch. In particular, a casing of the pump may form the rotary bearing of the first feed wheel.

The other feed wheel, preferably driven only by the first feed wheel and mating with the first feed wheel to form displacement pockets, is likewise rotatably supported to advantage by the casing. In this way, one and the same rigid body, namely the casing, preferably a single-piece casing part, forms the rotary bearing for the first feed wheel as well as the rotary bearing for the further, second feed wheel. The axes of rotation of the two feed wheels in the pump according to the invention are thus orientated relative to each other more precisely than when the feed wheels are supported on or upon elements moving relative to each other. In particular, the engagement of the two feed wheels with each other can now no longer be disrupted by the change in the loads acting on the rotary drive member, or at least far less than in known pumps. Inaccuracies stemming from assembly are also reduced. The magnetic clutch acts between the rotary drive member and the first feed wheel as a damping member against the transmission of disruptions or irregularities.

The magnetic clutch is preferably configured as a hysteresis or induction-type clutch, or a combination of both. Although less preferred, it is also, however, possible to configure it as a permanently magnetic clutch. The magnetic clutch comprises a magnetic rotating element of a permanently magnetic material in its input half and/or output half. Preferably, the magnetic rotating element is fitted to a soft-iron as a base. A rotating element of the other half of the clutch, producing with the magnetic rotating element the transmission of the magnetic torque, is formed by means of an induction material, or preferably by means of a hysteresis material or a combination of both. An induction material, for example Cu or Al, may form a feedback means and a base for a hysteresis rotating element. However, in such a combined hysteresis/induction clutch, a hysteresis/induction rotating element is preferably likewise fitted to a soft-iron as a base. If the rotating element consists solely of a hysteresis material or solely of an induction material, then a soft-iron likewise advantageously forms the base and the feedback means.

The magnetic clutch may be a face-acting or, more preferably, a centrally-acting rotary clutch. A combination of the two also represents a preferred embodiment.

A gear wheel pump is preferably formed by an internal gear wheel pump or an external gear wheel pump. A gear wheel pump may be formed particularly compactly when the two halves of the magnetic clutch form a central-type rotary clutch, or a combination central/face-type clutch in which the magnetically interacting, concentrically arranged rings encircle the mating feed wheels of the pump, preferably spaced radially from the feed wheels. The combination of an internal gear wheel pump with such a magnetic clutch is of particular advantage.

If the rotary drive member is formed by an input shaft, the first feed wheel preferably encircles the input shaft. However, it is also possible in principle to arrange the rotary drive member and the first feed wheel juxtaposed in the axial direction of the input shaft. In preferred alternative embodiments, the rotary drive member may also be a drive wheel, for example a gear wheel, a sprocket wheel, belt wheel or toothed belt wheel, which then preferably encircles the first feed wheel.

In a particularly preferable internal gear wheel pump, the first feed wheel and the second feed wheel are rotatably supported on or upon circular-cylindrical shell surfaces of the casing, these bearing surfaces preferably encircling each other. The cited magnetic material rings of the magnetic clutch advantageously encircle the two bearing surfaces for the feed wheels.

The invention is not restricted to the field of gear wheel pumps, but also permits advantageous application in the rotational drives of positive-displacement pumps, preferably oil pumps, and in principle pumps of all types. By the drive torque being introduced via a magnetic clutch into the pump, limiting or varying of the delivery, or a combination of both, may be achieved. When a hydrostatic pump or oil pump forms a gear wheel pump, as in preferred embodiments, then the delivery can be limited and/or varied according to requirement by means of the magnetic clutch, without any adjustment to the mating gear wheels of the pump. A variable-delivery external gear wheel pump is known from EP 0 994 257 A1, in which reference is made as an example of this type of pump. However, in a gear wheel pump configured in accordance with the invention, one of the mating gear wheels need to be axially shifted in order to achieve limited and/or varied delivery.

Where only limiting of delivery is required, the magnetic clutch is designed so that once an input half of the magnetic clutch has reached a predefined speed, a limiting torque transmissible by the magnetic clutch and predefined by the design—also described in the following more simply as maximum torque—is attained. If the speed of the input half increases further, the speed of the output half kinks to level off as compared with the speed of the input half. Upon attaining the limiting speed corresponding to the limiting torque—more specifically, the speed correspondingly predefined by the design the speed of the output half preferably remains constant over the speed range of the input half, in operation in excess thereof, or up to a predefined higher speed, as well as this may be approximated due to the magnetic interaction. The maximum torque is dependent on the air gap between the magnetically interacting rotating elements, the shape of the magnetically interacting rotating elements, the magnetically effective materials used, and the dimensions of the magnetically interacting rotating elements, in particular the size of the area collectively covered by these rotating elements of the two halves of the clutch, and a radial spacing of the coverage area from the rotational axis of the clutch. By a suitable selection of materials, dimensions and arrangement of the magnetically interacting rotating elements, the maximum torque of the clutch, and thus the maximum speed of the first feed wheel of the pump, is defined. Other influencing factors, such as for example changes in the viscosity of the pumped medium, affecting the relationship between maximum torque and speed, remains to be taken into account in this consideration. Thus, due to the torque being limited inherently by application of the magnetic clutch, a fail-safe limiting of delivery can be achieved very simply, without the clutch being changed in position, and without any additional means involving the feed wheel of a plurality of the feed wheels. In the case of an engine oil pump, for example, the so-called cold starting valve can thus be eliminated, since the magnetic clutch advantageously acts as a pressure controller, and may even be specifically designed to replace such a pressure control valve.

Limiting delivery may also be achieved by shifting the magnetically interacting rotating elements of the two halves of the clutch relative to each other and as a function of the delivery pressure. Preferably, one of the two halves of the clutch is shiftably supported by the casing of the pump relative to the other half, preferably along the axis of rotation, and such that when shifted relative to the other half of the clutch, the area covered by the magnetically interacting rotating elements of the two halves of the clutch, or a gap between the surfaces facing each other, is changed in size. In this way, the magnitude of the limiting torque as well is automatically changed. In the form of a feedback, the delivery pressure of the pump is placed on the shiftably supported half of the clutch. A spring member or spring-damping member is preferably arranged thereon as a restoring member, so as to counteract the delivery pressure. The magnetic force within the clutch halves, restoring in the direction of full overlap, may be used on its own or in combination with a mechanical or pneumatic spring, to maintain a particular delivery characteristic. A servomotor with an adjustable mechanism is advantageously not used.

The magnetic clutch and the restoring member are, for example, designed such that a delivery characteristic is attained, wherein: the pump exhibits a steep increase in the flow rate and/or delivery pressure, proportional in a first approximation to the speed of the pump, within a first pump speed range; the flow rate is quickly leveled off within a second, higher speed range, up to a preset pump speed; and the flow rate again increases with the pump speed in a third, even higher speed range of the input half of the magnetic clutch, continuing on from the preset pump speed, steeper than in the second speed range, or remains substantially constant in the third speed range. The restoring member can be set as desired, in particular by an arrangement of springs in series.

A delivery characteristic of the aforementioned type may be advantageously used in motor vehicles in which a pump for supplying the motor with it's lube oil in accordance with the invention is powered by the internal combustion engine of the vehicle, the speed of the pump thus having a fixed relation to the speed of the engine. In the lower engine speed range, i.e. when starting, vehicles immediately require large amounts of oil. Once a predefined engine speed, and thus the equivalent pump speed and delivery, is attained, no or at least no appreciable further increase in the flow rate of the pump is needed in the speed range continuing beyond the predefined engine speed. Once this medium speed range, in general the main operating range of the engine, has been passed, a high oil flow rate is again required at higher engine speeds, since at higher engine speeds higher centrifugal forces are involved at the points to be lubricated, for example at the crankshaft. Overcoming these increasingly significant centrifugal forces necessitates a higher oil pressure. In general, three speed ranges are to be distinguished in passenger cars; the lower engine speed range from 0 to approx. 1,500 rpm; the subsequent main operating range from approx. 1,500 to approx. 4,000 rpm; and the third, higher engine speed range from approx. 4,000 rpm onwards. To achieve the desired delivery characteristic, namely with a steep increase in the flow rate in the lower speed range, a comparatively slower increase or zero increase in the medium speed range, and finally another steeper increase in the upper speed range, a soft first governor spring is preferably connected in series with a comparatively harder second governor spring. A system of governor springs connected in series is preferably installed pretensioned, such that it hardly gives in the lower speed range. Once the pretension force is passed, as the transition is made between the lower and medium speed ranges, the soft first spring begins to flex until at the upper end of the medium speed range it comes up against the harder second governor spring. With further increase in speed, the characteristic is then determined by the harder, second governor spring.

The design of the clutch, for leveling off the increase in speed of the output half as compared with the input half beyond a limiting speed corresponding to the application in question, may advantageously be employed in combination with an adjustability of the clutch halves, provided for the purpose of changing the transmission characteristic.

The magnetically interacting rotating elements of the magnetic clutch are preferably jointly arranged in the pump casing, such that a temperature equalization of the rotating elements, preferably cooling, is achieved by the medium delivered by the pump. The surfaces of the magnetically interacting rotating elements facing each other particularly preferably face each other directly, and in the preferred arrangement in the pump casing, the medium to be delivered washes around these. In a particularly preferred embodiment, in which the magnetically interacting rotating elements are arranged jointly in the pump casing, facing each other directly, the outer surfaces of the rotating elements are only separated from each other by a thin film of the medium to be delivered.

If the pump is formed with a plurality of feed wheels, these are preferably supported by a rigid casing, preferably a single-piece casing part, not only in gear wheel pumps, but also in other pumps in accordance with the invention, for example worm wheel pumps or wing unit pumps, and not by elements which are relatively mobile with respect to each other, although the latter is not to be excluded in principle.

The two rotating elements of the magnetic clutch are advantageously rotatively mounted by the casing. The two rotating elements of the magnetic clutch are preferably rotatively mounted by the same casing as the first feed wheel or the several feed wheels. The two rotating elements of the magnetic clutch are particularly advantageously rotatively mounted by a single-piece casing. The rotating element of the input half is secured against rotation in its connection to the rotary drive member, but sufficiently mobile to be rotatively mounted by the casing.

A pump in accordance with the invention, when employed as an engine oil pump, in particular in motor vehicles, can be put to use not only as the lube oil pump for the engine and/or an automatic transmission, but may also be used to advantage, for example, for pumping fluid for hydraulic compensation of valve play and/or as a pump for varying valve timing. Application as a feed pump for an automatic transmission or a servo drive, for example a steering servo or in a braking system, is also advantageous.

BRIEF DESCRIPTION OF THE DRAWINGS

The invention will now be described by way of a preferred example embodiment. Features disclosed by way of the example embodiment, each alone and in any disclosed combination, advantageously develop the claimed invention. In the figures:

DETAILED DESCRIPTION

Figure 1:
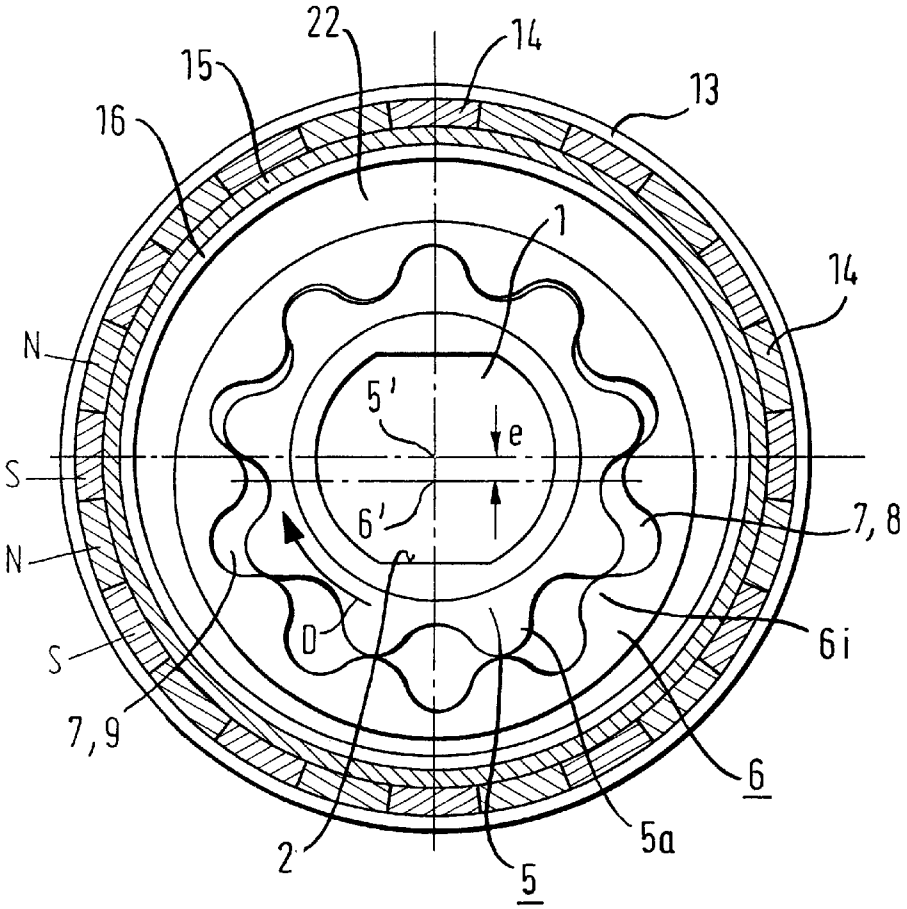
FIG. 1 is a cross-sectional view of an internal gear wheel pump, comprising a magnetic clutch.

FIG. 1 illustrates a cross-section through an internal gear wheel pump. The internal gear wheel pump comprises an internal rotor 5, including an outer toothing 5*a*, and an external rotor 6, including an inner toothing 6*i*, these forming by their outer and inner toothing a ring gear wheel set. The outer toothing 5*a* has one tooth less than the inner toothing 6*i*.

The internal rotor 5 and external rotor 6 are rotatably supported in a pumping chamber of a pump casing 3. The axis of rotation 6' of the external rotor 6 runs in parallel spacing from, i.e. eccentric to, the axis of rotation 5' of the internal rotor 5. The eccentricity, i.e. the spacing between the two axes of rotation 5' and 6', is designated "e".

The internal rotor 5 and the external rotor 6 form a fluid displacement space between themselves. This fluid displacement space is divided into pockets 7, each closed off pressure-tight relative to one another. Each of the individual pockets 7 is formed between two sequential teeth of the internal rotor 5 and the inner toothing 6*i* of the external rotor 6, by every two sequential teeth of the internal rotor 5 having tip or flank contact with every two sequential, opposing teeth of the inner toothing 6*i*.

From a point of full meshing to a point of minimum meshing, the pockets 7 expand in the direction of rotation D, before then contracting back from the point of minimum meshing to the point of full meshing. The expanding pockets 7 form a low-pressure side 8, and the contracting pockets 7 form a high-pressure side 9. The low-pressure side 8 is connected to a pump inlet port and the high-pressure side 9 to a pump outlet port. Kidney-shaped flutings with openings, laterally adjoining the pockets 7, are machined from the pump casing 3. At least one fluting covers pockets 7 on the low-pressure side 8 and at least one further fluting covers pockets 7 on the high-pressure side 9. In the area of the point of full meshing, and in the area of the point of minimum meshing, the casing forms sealing lands between the adjoining flutings. When the internal rotor 5 is rotationally driven, fluid is aspirated by the expanding pockets 7 on the low-pressure side 8, transported via the point of minimum meshing, and discharged at high pressure from the high-pressure side 9.

The pump receives its rotational drive from a rotary drive member formed by an input shaft 1. The input shaft 1 is guided relative to the casing 3 by a rotary bearing 4. In a preferred application of the pump as a lube or engine oil pump for supplying an internal combustion engine, in particular a piston engine, with lube oil, the input shaft 1 is typically the output shaft of a transmission, the input shaft of which is the crankshaft of the engine. In principle, the input shaft 1 may also be formed directly by a crankshaft. It can equally be formed by a balancer shaft for an engine force compensation or an engine torque compensation.

Unlike known gear wheel pumps, however, the internal rotor 5 is not seated non rotatably on the input shaft 1, but is instead rotatably supported relative to the input shaft 1 in and by the casing 3. Since the external rotor 6 is also rotatably supported in and by the casing 3 relative to the input shaft 1, rotatable supporting of the ring gear wheel set 5, 6 is achieved independently of the input shaft 1 by the same casing 3, which is completely and inherently stiff at least in its supporting portion. The mating feed wheels 5 and 6 can therefore be rotatably supported with a highly precise alignment relative to each other.

The ring gear wheel set 5, 6 receives its rotational drive from the input shaft 1 via a magnetic clutch. The magnetic clutch comprises two magnetically interacting rotating elements 14 and 15. These two rotating elements 14 and 15 are configured as ring elements and are arranged concentrically in the casing 3. The outer rotating element 14 is made of a magnetic material and comprises permanent magnetic distributed regularly over its perimeter which have alternately opposing polarities N and S on an inner shell surface in the direction of the perimeter. The magnetic material rotating element 14 is arranged on the inner shell surface of a soft-iron ring body 13, and connected to the ring body 13 non-rotatably, preferably completely fixed. The ring body 13 absorbs the operational forces. The magnetically interacting rotating element 15 is made of a hysteresis material. It may also be arranged on a circular-cylindrical ring of a good electrical conduct, such as copper. A radially laminated configuration is also feasible, having one or more layers of a good electrical conductor in alternate arrangement with one or more layers of a hysteresis material. A soft-iron ring body 16 forms the base of the hysteresis material rotating element 15, to which it is non-rotationally secured, and preferably completely fixed. The hysteresis material rotating element 15 encircles the ring body 16 and is located directly opposite the rotating element 14 and its outer shell surface. A ring gap remains between the two rotating elements 14 and 15, devised as thin as possible. The magnetic material rotating element 14 and the ring body 13 form an outer ring, and the hysteresis material rotating element 15 and ring body 16 an inner ring, of the magnetic clutch. The magnets may form the inner ring, and the hysteresis material the outer ring, instead. In all embodiments, the hysteresis material may be replaced by or combined with an induction material, to form an induction clutch or combination hysteresis/induction clutch. A formation as a hysteresis clutch alone is, however, preferred.

Figure 3:
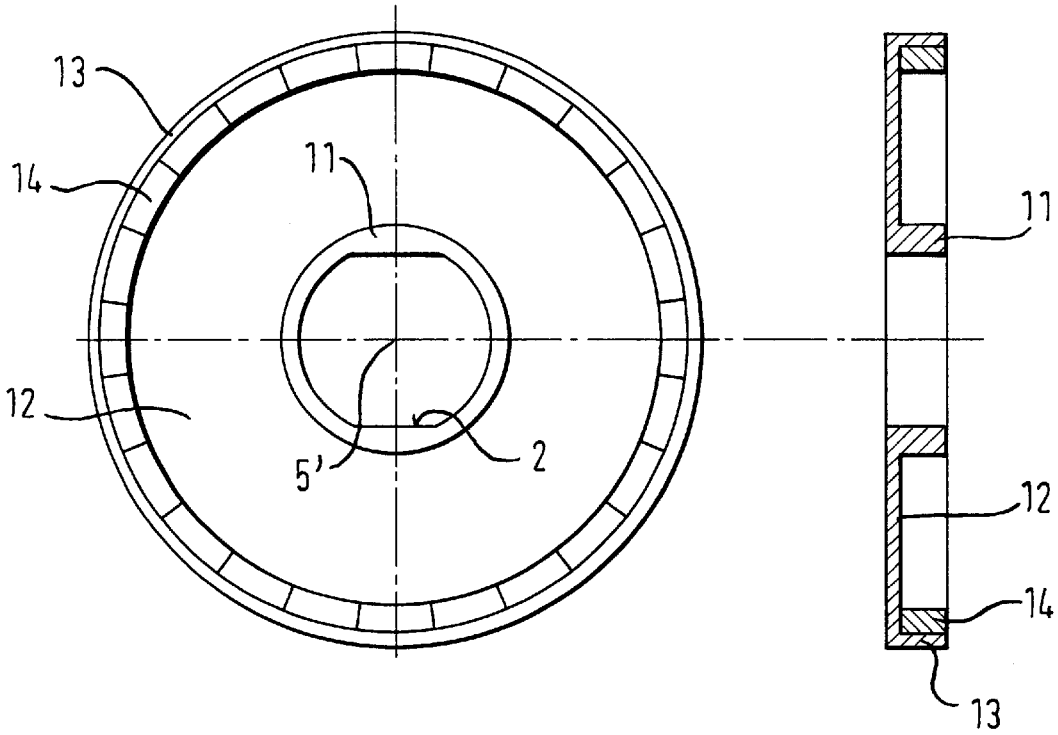
FIG. 3 shows the input half of the magnetic clutch.

In the drive train from the input shaft 1 to the ring gear wheel set 5, 6, an input half of the magnetic clutch, directly connected non-rotatably to the input shaft 1 and extending up to the magnetic material rotating element 14, is formed by a single stiff rotating element, also termed drive rotor in the following. The drive rotor is illustrated separately in a cross-section and a longitudinal section in FIG. 3. The drive rotor has the shape of a ring pot including an inner sleeve body 11, the outer ring 13, 14 and a radial connecting land 12. The sleeve body 11 is non-rotatably connected to the input shaft 1. This non-rotatable connection is formed by two opposing flats 2 of the input shaft 1 and corresponding companion flats in the sleeve body 11. The input shaft 1 thus forms a double flat in the seating portion of the sleeve body 11, and the sleeve body 11 forms the corresponding companion piece. The drive rotor can move radially and axially relatively to the input shaft to compensate for relative movements between the input shaft 1 and the housing. An outer shell surface of the sleeve body 11 is circular-cylindrical and extends from a free outer edge of the sleeve body 11 right to the bottom, i.e. to the connecting land 12, of the ring pot-shaped drive rotor of the magnetic clutch. The internal rotor 5 is rotatably supported by the casing 3 around this outer shell surface of the sleeve body 11, closely spaced from it.

Figure 4:
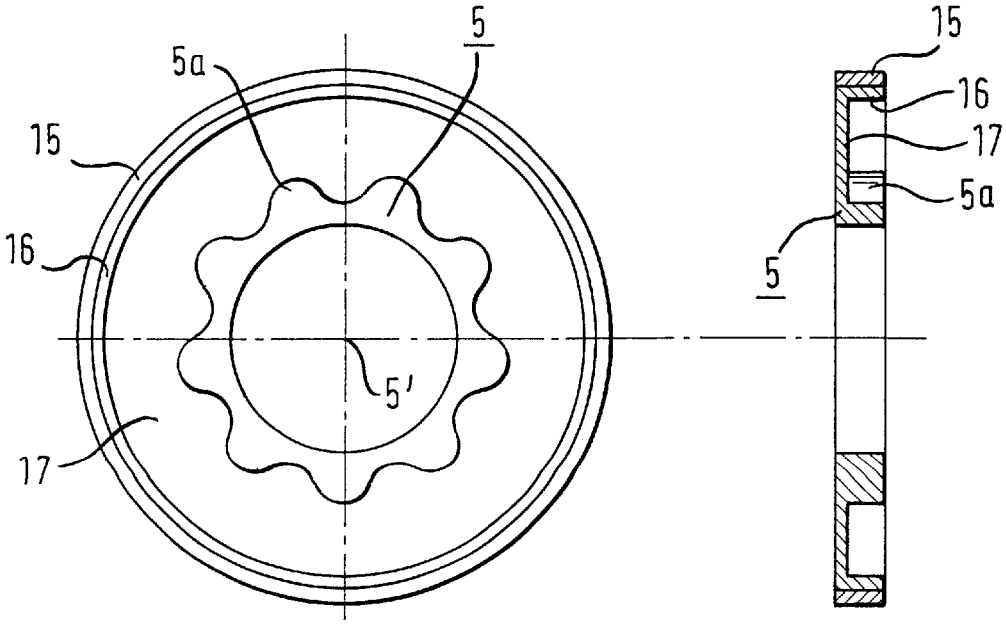
FIG. 4 shows the output half of the magnetic clutch.

An output half of the magnetic clutch is formed in the drive train in a similarly compact configuration by a single, stiff output rotor which is similarly ring pot-shaped. An integral component of the output rotor is the internal rotor 5. FIG. 4 illustrates the output rotor separately in a cross-section and a longitudinal section. The internal rotor 5 and the ring body 16 form the walls of the pot and are connected to each other non-rotatably, preferably completely rigidly, via a connecting land 17 forming the bottom of the pot. The internal rotor 5 and ring body 16, as well as the connecting land 17, may be manufactured from one piece. The single-layer or multi-layered hysteresis material rotating element 15 is, lastly, also a component of the output rotor.

Figure 7:
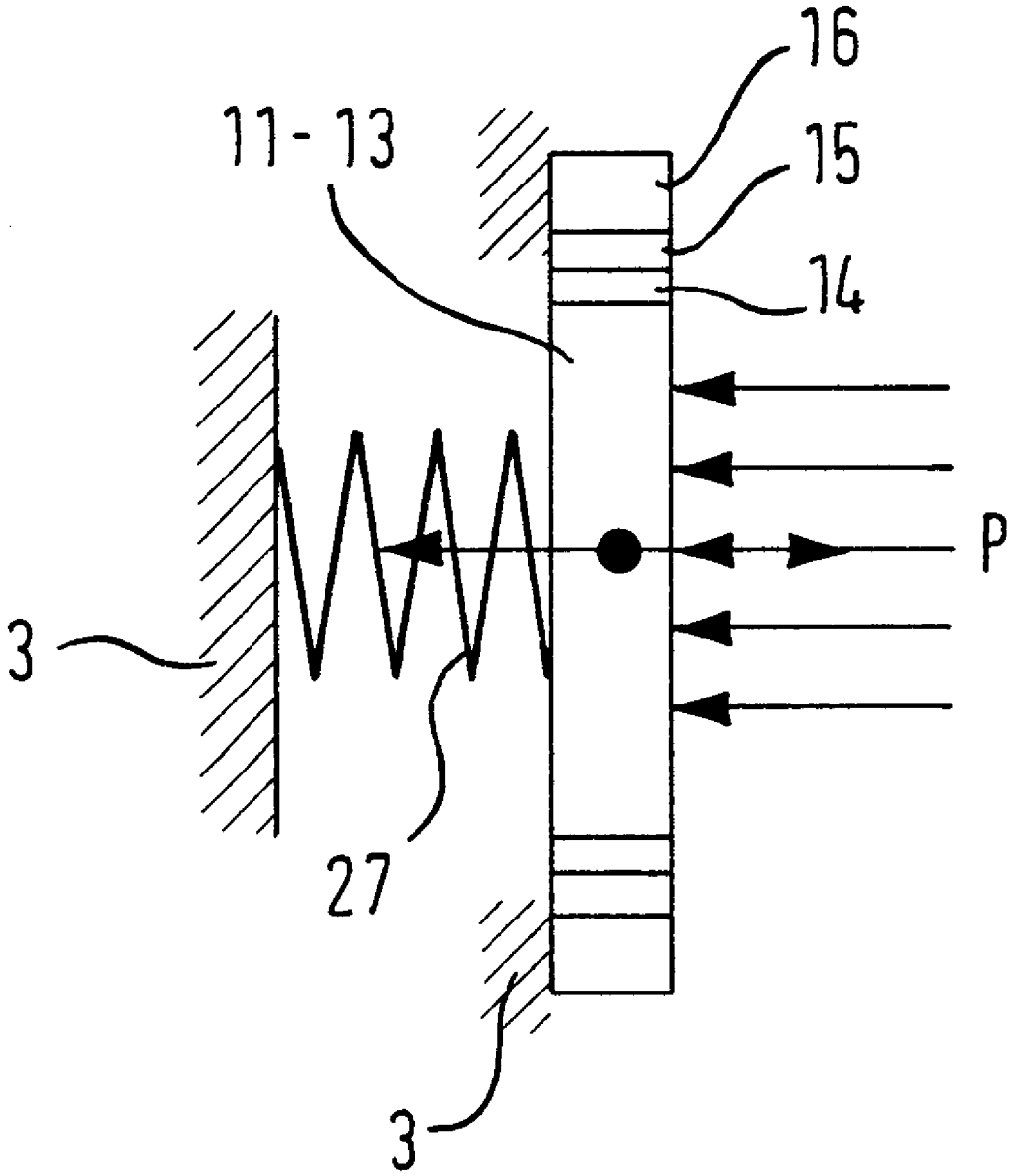
FIG. 7 is a schematic illustration of a pump with pressure-dependent, variable delivery.

FIG. 7 illustrates best how a particularly rigid and compact pump is achieved by the outer ring 13, 14 of the input half and the inner ring 15, 16 of the output half of the clutch being arranged encircling the ring gear wheel set 5, 6 in the casing 3. The ring pot formed by the input half 11–14 of the magnetic clutch accommodates the ring pot formed by the output half 15–17 of the magnetic clutch and the internal rotor 5. The connecting lands 12 and 17 are closely spaced from each other. The input half 11–14 of the magnetic clutch and the output half 15–17 together with the internal rotor 5 are rotatable about a common axis of rotation 5' relative to each other. The fact that the ring gear wheel set 5, 6 encircles the input shaft 1 also contributes towards the compactness of the pump; in the example embodiment, one shaft end of the input shaft 1 protrudes through the ring gear wheel set 5, 6. At the rear rend of the pump, the connecting land 17 defines the displacement space. The ports for the supply and discharge of the fluid on the low-pressure side and high-pressure side of the pump are machined into the wall of the pump casing 3 opposite the connecting land 17.

Figure 2:
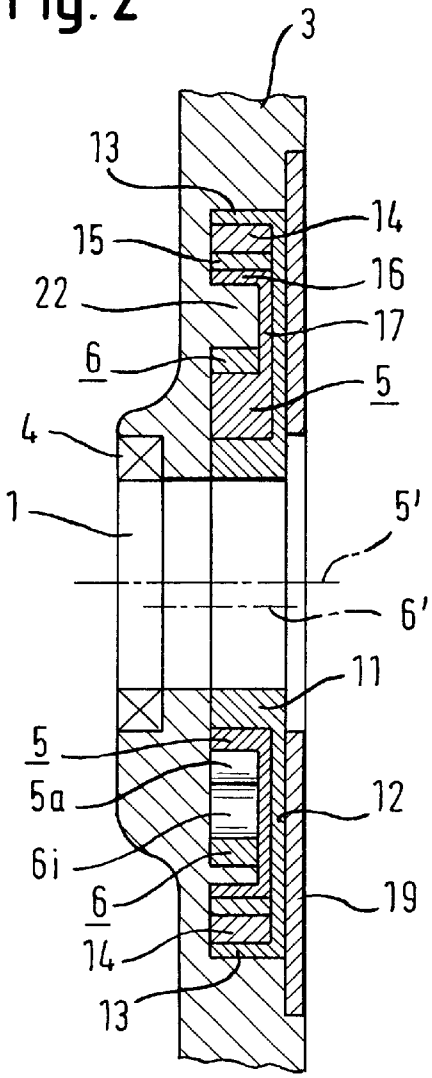
FIG. 2 is a longitudinal section through the pump.
Figure 6:
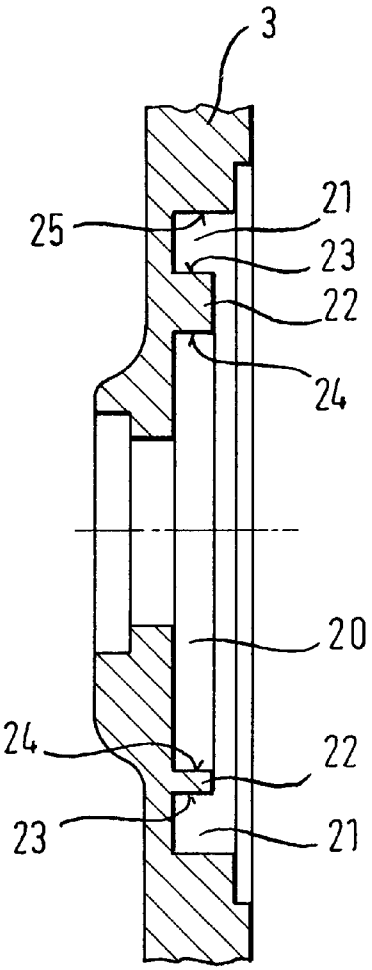
FIG. 6 is a longitudinal section through the casing.
Figure 5:
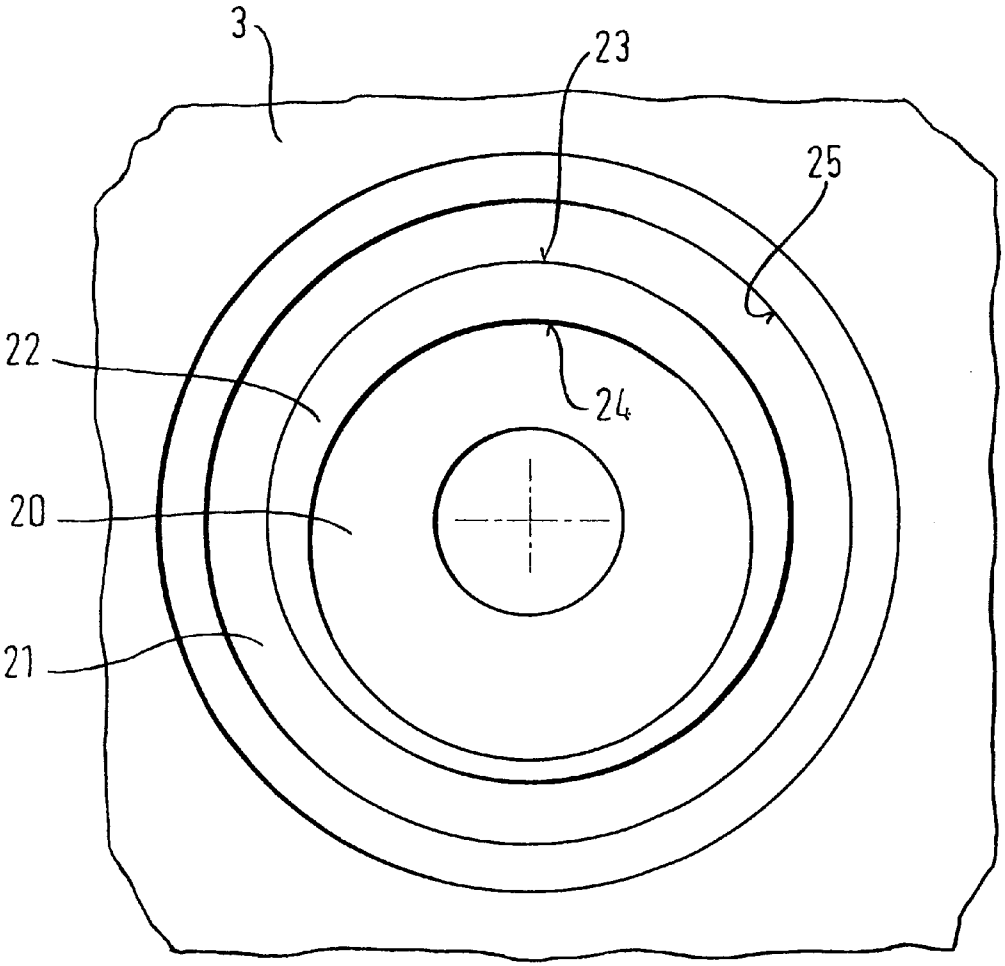
FIG. 5 is a view of the pump casing.

FIGS. 5 and 6 illustrate the casing 3. In particular, the compact and precise, but simple, means of supporting the ring gear wheel set 5, 6 and magnetic clutch is evident. The casing 3, formed preferably by a metal casting member, comprises an axial through-hole through which the input shaft 1 protrudes after assembly into the casing 3. The through-hole is flared at the rear end of the casing 3 into a bore 20 for the ring gear wheel set 5, 6. The bore 20 is encircled by a retaining ring 22. The retaining ring 22 is defined radially by two circular-cylindrical shell surfaces 23 and 24, and axially by a rear face. When the pump is assembled, as shown in FIGS. 1 and 2, the outer shell surface 23 is concentric to the axis of rotation 5', and the inner shell surface 24 concentric to the axis of rotation 6'. The outer shell surface 23, together with the inner shell surface of the ring body 16, forms a rotary sliding bearing for the internal rotor 5. The ring body 16 is thus not only the base for the hysteresis material rotating element 15, but simultaneously also the bearing ring for the internal rotor 5. The inner shell surface 24, together with the circular-cylindrical outer shell surface of the external rotor 6, forms the rotary sliding bearing of the external rotor 6, as is also the case with known internal ring gear wheel pumps. Furthermore, an annular space 21 is configured in the casing 3, encircling the retaining ring 22 and concentric to the axis of rotation 5'. The shell surface 23 forms a radially inner limit of the annular space 21. A circular-cylindrical, radial outer shell surface 25, lying opposite the shell surface 23, forms an outer limit of the annular space 21, and a running surface for the outer ring 13, 14. The drive rotor of the magnetic clutch is rotatively supported by the housing 3, namely on the shell surface 25 of the housing 3. When the pump is assembled, the outer ring 13, 14 and the inner ring 15, 16 of the magnetic clutch are rotatably supported in the annular space 21, relative to the casing 3.

Operation of the pump is as follows: rotation of the input shaft 1 about the axis of rotation 5' is transmitted to the input half 11–14 of the magnetic clutch 1:1. Rotation of the magnetic material rotating element 14 torques the hysteresis material rotating element 15 by magnetic flux. Rotation of the hysteresis material rotating element 15 also directly rotates the internal rotor 5. The internal rotor 5 mates with the external rotor 6 in the known way for inner ring gear wheel pumps, such that the pockets 7 as already described at the outset are formed, which expand on the low-pressure side 8 and contract back on the high-pressure side 9. The fluid aspirated on the low-pressure side 8 is delivered to the high-pressure side 9 and discharged at an elevated pressure.

In a preferred application of the pump, the delivery of the pump is required, in accordance with a preferred delivery characteristic, to first steeply increase with the speed from zero delivery, and then to remain constant once a specific value has been reached. To achieve such a delivery, the magnetic clutch is designed so that it transmits a limiting torque at an engine speed beyond which the engine or lube oil requirement levels off or remains quite constant, or at least no longer increases when the engine speed is further increased. Due to a magnetic clutch being configurable to a predefined limiting torque, the magnetic clutch is particularly suitable as a transmission member in the drive train of lube oil pumps for internal combustion engines, or in other applications of oil pumps in which the delivery response as describe above is advantageous.

By means of a magnetic clutch, adjusting or regulating the pump according to delivery pressure can furthermore be achieved without having to act on the ring gear wheel set of the pump. The configuration of a magnetic clutch as chosen in the example embodiment enables the limiting torque to be varied by axially shifting the two magnetically interacting rotating elements 14 and 15 relative to each other. Depending on the degree of coverage exhibited by the two facing shell surfaces of the rotating elements 14 and 15, the limiting torque can be set. The limiting torque can be one-time definitively set when the clutch is fitted, or also merely calibrated, by means of an inherently shiftable magnetic clutch. In this way, the same magnetic clutch can be used for pumps with differing specific displacements, to only limit delivery. Setting the limiting torque of the clutch by back-coupling with a closed loop control of the pump/magnetic clutch system is particularly preferred.

FIG. 7 illustrates schematically the physical control loop. The command variable for the governor is the speed of the input shaft 1. On the high pressure side 9, the delivery pressure of the pump increases with increasing drive speed. This delivery pressure P forms the controlled variable for the governor, by the delivery pressure P being applied to the axially shiftably supported half of the clutch. In the example embodiment, this is the input half 11–14. Instead of the direct delivery pressure of the pump, the pressure of a consumer, for example the engine oil pump, may be applied to the shiftable half of the clutch, in order to use the pressure, which ultimately defines the delivery adjustment, as the controlled variable. It is advantageous if the clean oil is returned from a point in the oil circuit between an oil filter arranged downstream of a pump outlet port, and the ruling consumer. The input half forms a shiftable regulator piston. The delivery pressure P acts on one side of the regulator piston. The elastic return force of a spring 27, tensioned between the casing 3 and the output half of the clutch by the effect of the delivery pressure P, acts on the other side of the regulator piston against the delivery pressure P. The shift location of the regulator piston is defined by the equilibrium between the delivery pressure P and the spring pressure. The spring 27 is installed, preferably pretensioned at zero delivery, between the casing 3 and the regulator piston.

The feeding characteristic of the pump can be tuned to the actual delivery requirement very precisely by means of such a governor system, without having to change the setting of the gear wheels. Thus, the delivery can be influenced, in the sense of an optimal delivery, on the one hand by correspondingly designing the magnetic clutch as such, in particular in designing it for a limiting torque, the spring characteristic of the spring 27 and also by the initial shift position of the two halves of the clutch relative to each other when the pump is at zero delivery. In general, coverage is maximal at zero delivery. However, as is evident from FIG. 7, it is also possible that the coverage of the two magnetic material rotating elements 14 and 15 is less than 100% relative to maximum coverage, at zero delivery. As the speed and thus the delivery pressure P increases, the two rotating elements 14 and 15 are first shifted relative to each other, such that as soon as a predefined speed is achieved, maximum coverage of 100% and thus largest limiting torque transmission by the clutch is attained. If the speed—and therefore the delivery pressure P continues to increase, then the degree of coverage falls back against the pressure of the spring 27. An adjustment of the transmissible limiting torque occurs. In addition to or instead of the spring 27, the immanent striving of the clutch towards full overlap may be used to counteract the pump pressure. If the clutch is always driven from the starting position at least up until attaining the largest possible limiting torque above its momentory limiting torque, then a particularly steep increase in the delivery occurs at low speeds of the rotary drive member.

Pressure regulation may be replaced by a temperature regulation. In this case, the regulator piston is replaced by a temperature-dependent actuator. The temperature-dependent actuator is formed by an element which alters its form according to temperature. The form-altering element can, for example, be a bi-metallic spring or an element made of an expanding material. A number of form-altering elements can also form the actuator. The form-altering actuator may be submerged in the medium being pumped, or merely thermoconductively connected to the casing, such that regulation is directly dependent on the temperature of the working medium or the casing.

Although it is an advantage of the invention that the single feed wheel or the several feed wheels of a pump need not be adjusted in order to limit and/or vary delivery, such an adjustment may be provided to advantage in conjunction with the installation of a magnetic clutch designed for a predefined limiting torque. By tuning the two mechanisms to each other, a plurality of delivery characteristics can be achieved, or a given pump adapted to a desired delivery characteristic with great precision. In the case of a gear wheel pump, for example, in addition to the magnetic clutch being variable or not, an adjustment of the specific delivery of the pump can be provided, for example an adjustment of the meshing length of the gear wheels of an outer gear wheel pump.

Figure 8:
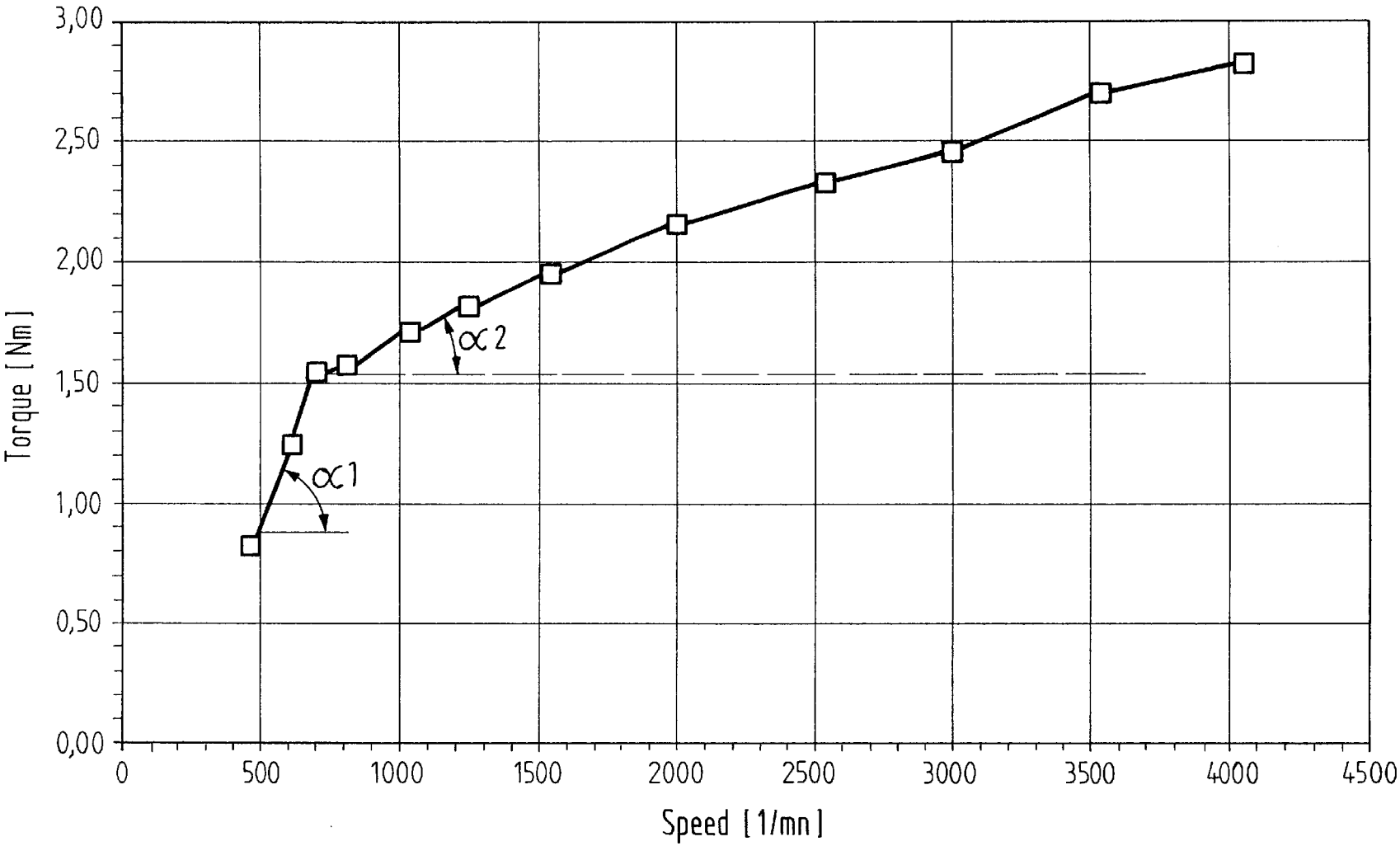
FIG. 8 a course of torque over the input speed of a test pump.

FIG. 8 shows the course of the torque over the speed of the rotary drive member, for an experimental pump comprising a hysteresis clutch in accordance with the invention. The magnetic clutch of the experimental pump is designed for a limiting torque of about 1.5 Nm, which under the conditions of the experiment is reached at a speed of the rotary drive member of about 700 rpm. The torque curve shows a sharp bend at the limiting torque, and levels off significantly once this has been reached. The gradient $\alpha 2$ of the torque curve after the limiting torque is advantageously at most half as great as the gradient $\alpha 1$ before the limiting torque has been reached, in all embodiments of the invention. Ideally, the torque transmitted by the clutch no longer increases once the limiting torque has been reached, but constant as indicated by the broken line. The course of the torque shown corresponds qualitatively with the course of the speed of the output half of the magnetic clutch, i.e. the speed of the output half increases in the ratio 1:1 with the speed of the input half up until the limiting torque, and bends off sharply at the limiting torque defined by the design. The gradient of the speed curve after the limiting torque is preferably also at most half as great as the gradient before the limiting torque has been reached, in all embodiments of the invention.

In the foregoing description a preferred embodiment of the invention has been presented for the purpose of illustration and description. It is not intended to be exhaustive or to limit the invention to the precise form disclosed. Obvious modifications or variations are possible in light of the above teachings. The embodiment was chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

LIST OF REFERENCE NUMERALS

1 rotary drive member, input shaft
2 flat
3 casing
4 shaft bearing
5 first feed wheel, internal rotor
5' axis of rotation
**5*a*** outer toothing
6 second feed wheel, external rotor
6' axis of rotation
**6*i*** inner toothing
7 displacement space, pockets
8 low-pressure side
9 high-pressure side
10 -
11 sleeve body
12 connecting land
13 ring body
14 magnetic material rotating element
15 magnetic material rotating element
16 bearing ring, ring body
17 connecting land
18 -
19 casing cover
20 bore
21 annular space
22 retaining ring
23 bearing surface
24 bearing surface
25 running surface
26 -
27 spring

What is claimed is:

1. A positive displacement pump comprising:

a) a rotary drive member driven at a speed dependent on a speed of a driving motor;

b) a casing;

c) a first feed wheel arranged in said casing, said first feed wheel being coupled to said rotary drive member for introducing a torque, and a second feed wheel arranged in said casing, said second feed wheel mating with said first feed wheel;

d) said first feed wheel forming, with the walls of said casing and in conjunction with said second feed wheel, a delivery space comprising a low-pressure side connected to a pump inlet port and a high-pressure side connected to a pump outlet port;

wherein:

e) limiting delivery of said pump is achieved by using a magnetic hysteresis clutch which couples said rotary drive member to said first feed wheel for transmitting said torque;

f) an input half of said magnetic clutch is non-rotatably connected to said rotary drive member, and an output half of said magnetic clutch is non-rotatably connected to said first feed wheel;

g) and said magnetic clutch is designed with regard to a limiting torque, such that when said output half reaches a speed predefined by the design and without adjusting said input half and said output half relative to each other, said predefined speed increases more slowly than the speed of said input half when said input half exceeds said predefined speed, wherein said predefined speed is less than a maximum operating speed of said input half.

2. The pump as set forth in claim 1, wherein said first feed wheel is rotatably supported relative to said rotary drive member.

3. The pump as set forth in claim 1, wherein said first feed wheel is rotatably supported by said casing.

4. The pump as set forth in claim 1, wherein said rotary drive member is an input shaft and said first feed wheel is rotatably supported about said input shaft.

5. The pump as set forth in claim 1, wherein said magnetic clutch comprises two magnetically interacting rotating elements which are jointly received in said casing, to be cooled by the medium to be delivered.

6. The pump as set forth in claim 1, wherein said pump is an internal gear wheel pump, comprising an internal rotor forming said first feed wheel and an external rotor forming said second feed wheel, and an outer toothing of said internal rotor meshing with an inner toothing of said external rotor, having at least one tooth less than said inner toothing.

7. The pump as set forth in claim 1, wherein said first feed wheel is formed by a gear wheel and said second feed wheel is formed by a gear wheel.

8. The pump as set forth in claim 1, wherein the pump is a lube oil pump for an internal combustion engine.

9. The pump as set forth in claim 1, wherein a bearing surface rotatably supporting said first feed wheel and a bearing surface rotatably supporting said second feed wheel are formed by said casing or are rigidly connected to said casing.

10. The pump as set forth in claim 9, wherein one of said bearing surfaces encircles the other of said bearing surfaces.

11. The pump as set forth in claim 1, wherein said first feed wheel is non-rotatably connected to a bearing ring, and said bearing ring forms, with said casing, a rotary bearing for said first feed wheel.

12. The pump as set forth in claim 11, wherein a bearing surface formed by said bearing ring has a diameter which is larger than an outer diameter of said first feed wheel.

13. The pump as set forth in claim 11, wherein said bearing ring encircles said first feed wheel.

14. The pump as set forth in claim 11, wherein said first feed wheel is fixed to said bearing ring.

15. The pump as set forth in claim 1, wherein said magnetic clutch comprises two magnetically interacting ring elements which encircle each other and said first feed wheel.

16. The pump as set forth in claim 15, wherein said ring elements encircle said second feed wheel.

17. A pump comprising:

a) a rotary drive member driven at a speed dependent on a speed of a driving motor;

b) a casing;

c) a first feed wheel arranged in said casing, said first feed wheel being coupled to said rotary drive member for introducing a torque, and a second feed wheel arranged in said casing, said second feed wheel mating with said first feed wheel;

d) said first feed wheel forming, with the walls of said casing and in conjunction with said second feed wheel, a delivery space comprising a low-pressure side connected to a pump inlet port and a high-pressure side connected to a pump outlet port;

wherein:

e) a magnetic clutch couples said rotary drive member to said first feed wheel for transmitting said torque;

f) an input half of said magnetic clutch is non-rotatably connected to said rotary drive member, and an output half of said magnetic clutch is non-rotatably connected to said first feed wheel;

g) said input half and said output half are shiftable relative to each other, to thus vary the transmissible maximum torque of said magnetic clutch;

h) and said shiftably supported input half and/or output half is exposed in a shifting direction to a pump pressure, counteracted by an elastic restoring force.

18. The pump according to claim 17, wherein said pump is a positive-displacement pump.

19. The pump as set forth in claim 17, wherein a spring is provided to generate said restoring force.

20. The pump as set forth in claim 17, wherein said first feed wheel is rotatably supported relative to said rotary drive member.

21. The pump as set forth in claim 17, wherein said first feed wheel is rotatably supported by said casing.

22. The pump as set forth in claim 17, wherein said rotary drive member is an input shaft and said first feed wheel is rotatably supported about said input shaft.

23. The pump as set forth in claim 17, wherein said magnetic clutch comprises two magnetically interacting rotating elements which are jointly received in said casing, to be cooled by the medium to be delivered.

24. The pump as set forth in claim 17, wherein the magnetic clutch is a hysteresis clutch.

25. The pump as set forth in claim 17, wherein said first feed wheel is formed by a gear wheel and said second feed wheel is formed by a gear wheel.

26. The pump as set forth in the claim 17, wherein said pump is an internal gear wheel pump, comprising an internal rotor forming said first feed wheel and an external rotor forming said second feed wheel, and an outer toothing of said internal rotor meshing with an inner toothing of said external rotor, having at least one tooth less than said inner toothing.

27. The pump as set forth in claim 17, wherein the pump is a lube oil pump for an internal combustion engine.

28. The pump as set forth in claim 17, wherein a bearing surface rotatably supporting said first feed wheel and a bearing surface rotatably supporting said second feed wheel are formed by said casing or are rigidly connected to said casing.

29. The pump as set forth in claim 28, wherein one of said bearing surfaces encircles the other of said bearing surfaces.

30. The pump as set forth in claim 17, wherein said first feed wheel in non-rotatably connected to a bearing ring, and said bearing ring forms, with said casing, a rotary bearing for said first feed wheel.

31. The pump as set forth in claim 30, wherein a bearing surface formed by said bearing ring has a diameter which is larger than an outer diameter of said first feed wheel.

32. The pump as set forth in claim 30, wherein said bearing ring encircles said first feed wheel.

33. The pump as set forth in claim 30, wherein said first feed wheel is fixed to said bearing ring.

34. The pump as set forth in claim 17, wherein said magnetic clutch comprises two magnetically interacting ring elements which encircle each other and said first feed wheel.

35. The pump as set forth in claim 34, wherein said ring elements encircle said second feed wheel.

* * * * *

UNITED STATES PATENT AND TRADEMARK OFFICE

CERTIFICATE OF CORRECTION

PATENT NO. : 6,544,019 B2
DATED : April 8, 2003
INVENTOR(S) : Hans Martin et al.

It is certified that error appears in the above-identified patent and that said Letters Patent is hereby corrected as shown below:

Title page,
Item [56], References Cited, OTHER PUBLICATIONS, insert:
-- Abstract of Japanese Patent Publication No. 02-153281, published June 12, 1990. --

Signed and Sealed this

Fifth Day of August, 2003

JAMES E. ROGAN
*Director of the United States Patent and Trademark Office*